US005429257A

United States Patent [19]

Greenfield et al.

[11] Patent Number: 5,429,257

[45] Date of Patent: Jul. 4, 1995

[54] CLOSURE WITH FOREARM ENGAGING TABS FOR MEDICATION CONTAINERS

[75] Inventors: Brian Greenfield, 3450 Drummond, Apt. 1114, Montreal, Quebec, Canada, H3G 1Y2; Etienne Guay, Montreal, Canada

[73] Assignee: Brian Greenfield, Montreal, Canada

[21] Appl. No.: 978,370

[22] Filed: Nov. 18, 1992

Related U.S. Application Data

[63] Continuation-in-part of Ser. No. 876,438, Apr. 30, 1992, abandoned, and a continuation-in-part of Ser. No. 788,510, Nov. 6, 1991, abandoned.

[51] Int. Cl.[6] ..... B65D 43/26

[52] U.S. Cl. ..... 215/295; 215/305; 81/3.15

[58] Field of Search ..... 215/295, 301, 303, 304, 215/305, 215; 220/284, 285, 286; 81/3.09, 3.15, 3.44, 3.45, 3.55, 3.56, 3.57

[56] References Cited

U.S. PATENT DOCUMENTS

| | | |
|---|---|---|
| 1,207,560 | 12/1916 | Keeran . |
| 1,636,487 | 7/1927 | Read . |
| 1,993,141 | 3/1935 | Hartwell . |
| 3,185,332 | 5/1965 | Greenstein . |
| 3,667,638 | 6/1972 | Cambio . |
| 3,842,790 | 10/1974 | Clark . |
| 3,885,478 | 5/1975 | Evans . |
| 4,235,132 | 11/1980 | Kendall . |
| 4,311,259 | 1/1982 | Babiol . |
| 4,469,235 | 9/1984 | Parker . |
| 4,731,512 | 3/1988 | Barriac . |
| 4,760,763 | 8/1988 | Trick . |
| 4,770,069 | 9/1988 | Mikan . |
| 4,840,093 | 6/1989 | Goldman . |
| 4,911,038 | 3/1990 | Ferrin . |
| 4,919,015 | 4/1990 | Pohjola . |
| 4,981,228 | 1/1991 | Kahn . |

FOREIGN PATENT DOCUMENTS

| | | |
|---|---|---|
| 38477 | 6/1931 | France . |
| 08220 | 8/1985 | Germany . |
| 158786 | 2/1933 | Switzerland . |

*Primary Examiner*—Allan N. Shoap
*Assistant Examiner*—Nova Stucker
*Attorney, Agent, or Firm*—Darby & Darby

[57] ABSTRACT

To assist a person having reduced manual dexterity in removing a twist closure from a container, the closure comprises a first tab extending upright from an upper surface of the closure to a height suitable to engage the forearm near a central portion of the ulna, and a second upright tab having the same height and being positioned on the upper surface to be on an opposite side of the forearm and longitudinally offset to allow the forearm to press against the tabs and provide an opening torque. A forearm of the person is positionable on the closure with the ulna of the forearm over the upper surface and the first and second tabs extending upright on opposite sides of the forearm, such that the closure can be opened by putting weight using the forearm on the upper surface with the container on a fixed surface and turning the forearm within the first and second tabs. No forceful digital, manual or carpal movements are required to remove the closure.

7 Claims, 2 Drawing Sheets

CLOSURE WITH FOREARM ENGAGING TABS FOR MEDICATION CONTAINERS

This application is a continuation-in-part of application Ser. No. 876,438 filed Apr. 30, 1992, abandoned, which is a continuation-in-part of Ser. No. 788,510 filed Nov. 6, 1991, abandoned.

FIELD OF THE INVENTION

The present invention relates to a closure with forearm engaging tabs for containers. The present invention relates further to an apparatus to assist a person having reduced manual dexterity, such as an arthritic patient, in removing a closure from a container, such as a medication bottle. The apparatus is to be attached to or made integral with the closure of the container.

BACKGROUND OF THE INVENTION

Arthritic patients commonly have difficulties in removing closures from medication containers since the operation of removing the closures from medication containers requires a manual dexterity which is beyond the ability of arthritic patients who no longer have full use of their hands. It has been observed that arthritic patients have more control over the movement of the arm and forearm than the movement of the wrist and fingers.

It is known to provide cap removers for medication containers, as is disclosed in U.S. Pat. Nos. 4,760,763, 4,770,069 and 3,885,478. In the case of U.S. Pat. No. 4,760,763, a device is disclosed for gripping the cap of a child resistant medication container which facilitates removal of the cap by an arthritic patient by reducing the amount of gripping action that needs to be carried out by the hand and provides a device which will enable opening a cap using the palm of one's hand. U.S. Pat. No. 4,770,069 discloses a hand-held cap opener for child resistant containers of the kind which are to be pried off, in which the cap opener fits into the palm of the hand and prevents the user from having to use delicate finger action to remove the cap. U.S. Pat. No. 4,731,512 discloses a two-piece, press-twist, child resistant closure which is formed with upwardly extending lugs to assist in holding the outer closure against rotation while being manually pressed and turned using the bottle. U.S. Pat. No. 4,469,235 describes a closure with upwardly extending tabs to enable manual application of torque to the closure without gripping the side wall thereof.

In the prior art devices, use of the wrist or fingers is required in order to remove the closure. As mentioned above, for arthritic patients it can be impossible to comfortably use the wrist or finger joints to carry out a controlled movement, whereas the use of the forearm and arm can be carried out with greater ease.

It is therefore an object of the present invention to provide a closure with forearm engaging tabs for medication containers which does not require the use of forceful manipulation by the wrist or finger joints.

SUMMARY OF THE INVENTION

According to the invention, there is provided an apparatus to assist a person having reduced manual dexterity in removing a closure from a container using a forearm, comprising a base having means for connecting to the closure, a first tab extending upright from the base to a height equivalent to a central portion of an ulnar bone of the forearm, and a second upright tab parallel to the first tab and extending upright from the base to the central portion height, and located on an opposite side of the forearm and spaced longitudinally with respect to the first tab to allow a torque to be transferred to the base by applying force with the forearm to the first and second tabs. The forearm of the person is positionable on the apparatus with the ulnar bone of the forearm over the base and the first and second tabs extending upright on opposite sides of the forearm, such that the apparatus can be used to twist open the closure by placing weight with the forearm on the base with the container supported on a fixed surface and turning the forearm within the first and second tabs.

The invention also provides a closure for a container, the closure having an upper surface provided with a first upstanding tab extending to a height with respect to the upper surface equivalent to a central portion of an ulnar bone of the forearm, a second upstanding tab extending upright from the upper surface to the central portion height, and being parallel to the first tab and located on an opposite side of the forearm and spaced longitudinally with respect to the first tab to allow a torque to be transferred to the closure by applying force by the forearm to the first and second tabs.

BRIEF DESCRIPTION OF THE DRAWINGS

The invention will now be better understood by way of the following detailed description of a preferred embodiment with reference to the appended drawings in which.

DETAILED DESCRIPTION OF THE PREFERRED EMBODIMENT

Figure 1:
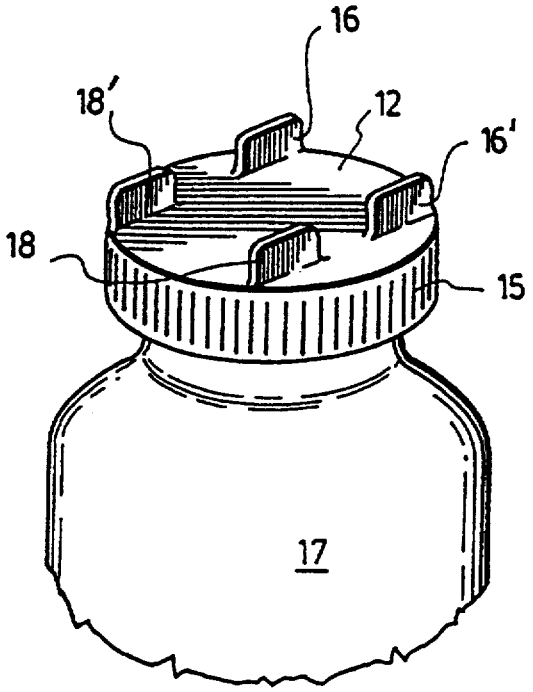
FIG. 1 shows a perspective view of the preferred embodiment attached to a pill bottle.
Figure 2:
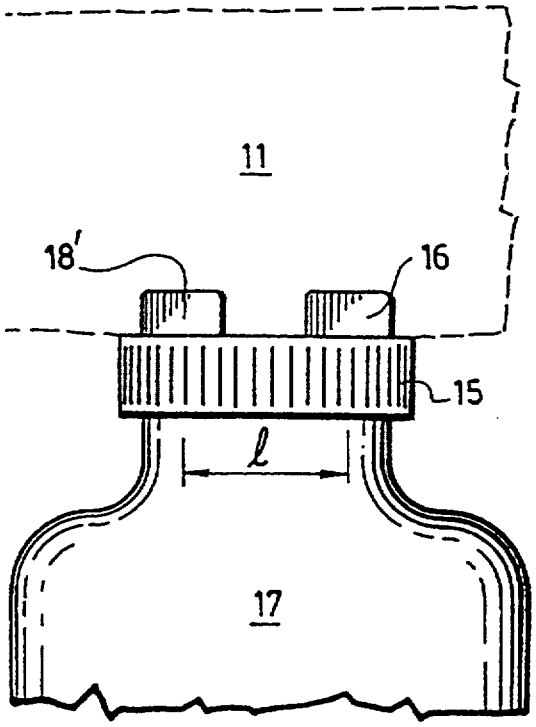
FIG. 2 shows a side view of the preferred embodiment.
Figure 3:
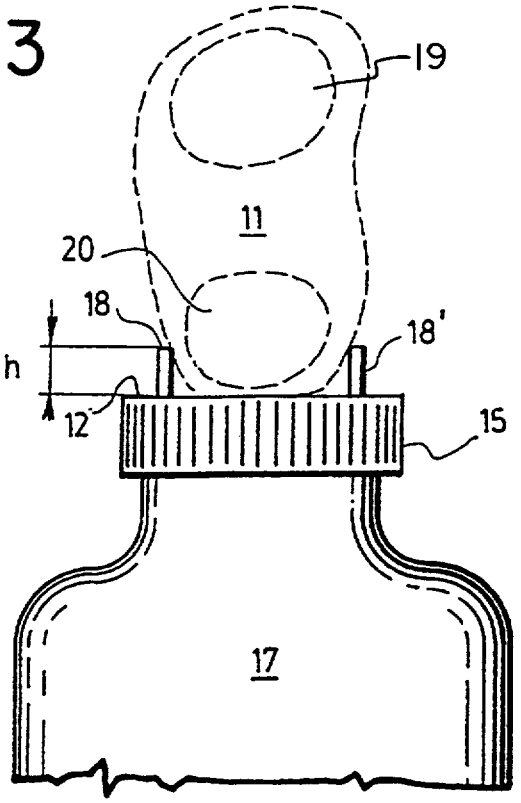
FIG. 3 is a front view showing the forearm in cross-section of the preferred embodiment.

As shown in FIGS. 1, 2 and 3, the closure (15) which is of the push-and-turn type is provided with two upstanding tabs (16) and (18), such that when the forearm (11) is placed on base (12) between the tabs (16) and (18), the latter are engaged in order to turn the closure or cap (15) anticlockwise (for removal). The tabs (16) and (18) have parallel surfaces and are spaced apart in width W which corresponds to the width of the lower part of the forearm (11), and a lengthwise distance between tabs (16) and (18) is chosen to be as long as possible while remaining on base (12) of cap (15). The height H of the tabs as shown in FIG. 3 is chosen to correspond to an average middle of the ulnar bone (20) in order that as forearm (11) is twisted the force transmitted by the ulnar bone (20) does not cause the forearm (11) to rise over tabs (16) and (18). It has been found that for smaller boned patients, as is common with more elderly female patients, the minimum height of tabs (16) and (18) is ⅜" (roughly 10 mm). The same tests have shown that a suitable width is 1¼" (32 mm), and a suitable lengthwise distance between tabs (16) and (18) is also 1¼" (32 mm). The ulnar bone (20) extends from the wrist to the elbow, and the user may use any portion of the forearm that feels comfortable.

Container (17) is to be placed on a surface which is preferably at waist height with respect to the arthritic patient, and the forearm (11) is placed on base (12) with the tabs protruding upwardly on each side of the forearm to a height approaching or near the center of the ulnar bone (20) with the radial bone (19) positioned above the ulnar (20) (a relaxed position), and while some weight is applied to base (12), usually coming from the shoulder and transferred through the elbow, a small turning force is applied to loosen cap (15) from container (17). Once the cap (15) is loose, additional turning of cap (15), if required, can be carried out using a minimum of force and without use of the fingers or hands by pushing against the tabs with the forearm to cause the cap (15) to turn. In this preferred way, the container (17) does not need to be held using the other hand in order to prevent it from slipping or turning since most counter top surfaces provide sufficient friction on the base of container (17) when a little bit of weight is applied to base (12) by forearm (11). If extra friction is required, then the container (17) can be placed on a cloth or rubber surface which will offer a better frictional contact. The placing of weight by forearm (11) and in particular by ulnar bone (20) does not cause discomfort to the patient and more importantly does not require the use of the wrist joint or finger joints.

Complementary tabs (16') and (18') can be used to apply torque using the forearm in an opposite direction, i.e. to close cap (15).

As can be understood, it would be possible to join tabs (16) or (18) to tabs (18') or (16') respectively. It is also possible to angularly shift tabs (16') and (18') with respect to tabs (16) and (18) as long as the pair of tabs (16) (18) and (16') (18') engage forearm (11) in such a way that turning the forearm (11) causes the ulnar bone (20) to turn base (12) and thus cap (15) in the desired direction.

Although in the preferred embodiment the base (12) is provided integrally with cap (15), it is of course possible to make an attachment apparatus in which base (12) is provided separate from cap (15) and merely attaches to an ordinary cap (15). Snaps, adhesive strips or a friction fit over the cap (15) are some of the possible ways to connect the base (12) to the cap (15). The twist cap or closure (15) can be an ordinary screw cap, a push-and-turn one piece cap in which the base is usually locked until depressed, or a two-piece push-and-turn closure in which the outer base slips until depressed when it will engage an inner screw cap.

Figure 4:
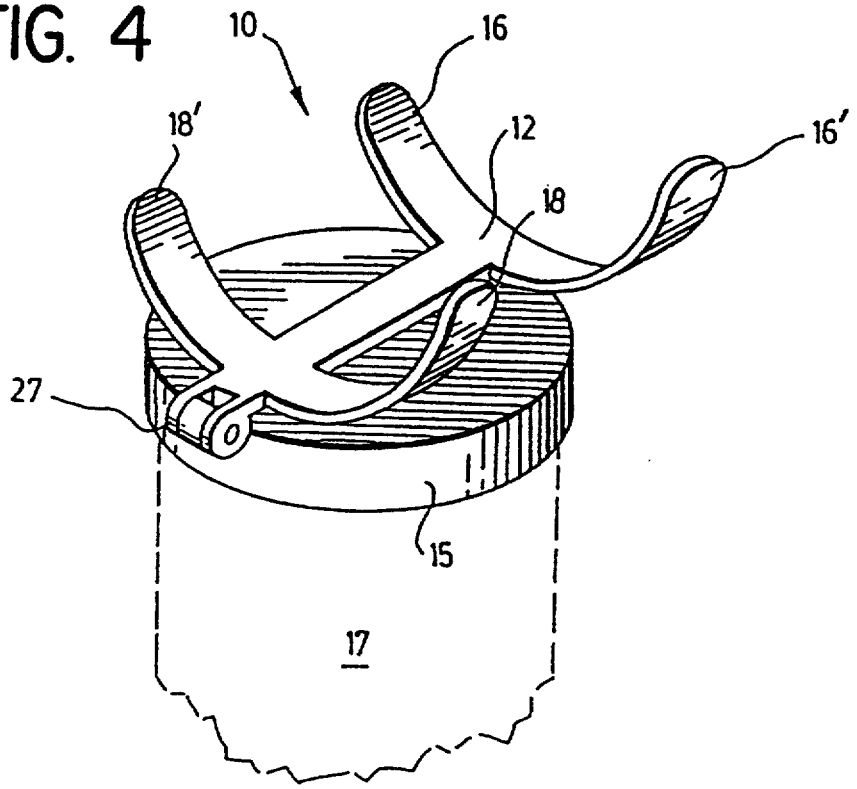
FIG. 4 is a perspective view of an alternative embodiment in which the base is hingedly placed on top of the cap, and the tabs are made much larger.

In the alternative embodiment shown in FIG. 4, tabs (16) and (18) as well as tabs (16') and (18') are connected to a base (12) which is hingedly connected to cap (15) by articulation hinge (27). When base (12) is folded down into the storage position (not shown), it does so with rounded tabs (16) (16') (18) and (18') "hugging" bottle (17). The tabs in the alternative embodiment are much larger, and are curved to conform to the contour of the forearm (11). The articulated base (12) allows the larger tabs to be lowered in order to reduce the storage volume of the container (17) provided with the tabs (16) and (18). The larger curved tab arrangement of FIG. 4 works not only with the ulnar side of the forearm but also with the fleshy, inside surface of the forearm.

It is to be understood that the above description of the preferred embodiment is not intended to limit the scope of the present invention as defined in the appended claims.

What is claimed is:

1. An apparatus to assist a person having reduced manual dexterity in removing a twist closure from a container using a forearm, comprising:

a base having means for connecting to the closure and having a surface engagable by a portion of a user's forearm;

a first tab extending upright from the base to a height, said tab having a first vertical side surface parallel to and spaced from a line in the plane of the base passing generally through a middle portion of said base; and a second tab extending upright from the base to about said height, said second tab having a second vertical side surface substantially parallel to said line, and said first and second vertical side surfaces being spaced from each other and extending upright from opposite sides of said base relative to said line by at least a minimum width equivalent to a width of a narrow portion of the ulnar side of the user's forearm, said height of said first and second tabs being sufficient to engage the narrow portion of the ulnar side of the user's forearm and to transmit torque to said base upon twisting of the forearm when located between the first and second tabs, said first and second vertical side surfaces being positioned so as to generally flatly engage opposite sides of the narrow portion of the ulnar side of the forearm when placed therebetween, whereby the forearm is positionable over the base and between the first and second tabs such that the apparatus can be used to twist open the twist closure by turning the forearm about an axis of rotation of such twist closure as the forearm engages both of the first and second tabs.

2. Apparatus as claimed in claim 1, further comprising a third tab extending upright from the base to said height and a fourth tab extending upright from the base to said height, said third and fourth tab having vertical side surfaces parallel to one another and spaced apart so as to be on opposite sides of the forearm so as to allow a closing torque to be transferred to said base by applying force by the forearm to the third and fourth tabs, said third and fourth tabs being positioned such that when the forearm is placed between them there is no interference with said first and second tabs.

3. Apparatus as claimed in claim 2, wherein said vertical side surfaces of said first, second, third and fourth tabs are all parallel, said first and third tab being joined to each other, and said second and fourth tabs also being longitudinally joined.

4. An apparatus as claimed in claim 1, wherein said height is of at least ⅜ of an inch.

5. A twist closure for a container, the closure having an upper surface engagable by a narrow portion of an ulnar side of a user's forearm and being provided with first and second upstanding tabs spaced apart sufficient to receive the narrow portion of the ulnar side of the user's forearm and extending to a height sufficient to engage the portion of the user's forearm, said first and second tabs having first and second vertical side surfaces respectively generally parallel to one another and located for engaging opposite sides of the narrow portion of the ulnar side of the forearm so as to allow a torque to be transferred to the closure by applying force with the forearm to the first and second tabs with said vertical side surfaces generally flatly engaging opposite sides of the narrow portion of the ulnar side of the forearm, whereby the forearm is positionable on the apparatus such that the closure can be twisted open by turning the forearm about an axis of rotation of the closure as said forearm engages the first and second tabs.

6. Closure as claimed in claim 5, further comprising a third tab extending upright from the base to height, and a fourth tab extending upright from the base to height, said third and fourth tabs having third and fourth vertical side surfaces respectively parallel to one another and being spaced apart so as to be located on opposite sides of the forearm another to allow a closing torque to be transferred to said base by applying force by the forearm to the third and fourth tabs, said third and fourth tabs being positioned such that when forearm is placed between them there is no interference with said first and second tabs.

7. Closure as claimed in claim 6, wherein said side surfaces of said first, second, third and fourth tabs are all parallel, said first and third tab being joined to each other, and said second and fourth tabs also being joined to each other.

* * * * *